US009080269B2

(12) United States Patent
Osanai et al.

(10) Patent No.: US 9,080,269 B2
(45) Date of Patent: Jul. 14, 2015

(54) NEEDLE THREADER OF SEWING MACHINE AND SEWING MACHINE

(71) Applicant: JANOME SEWING MACHINE CO., LTD., Hachioji-shi, Tokyo (JP)

(72) Inventors: Yasuhiro Osanai, Hachioji (JP); Yasuhiko Komiya, Hino (JP)

(73) Assignee: JANOME SEWING MACHINE CO., LTD., Hachioji-Shi, Tokyo (JP)

( * ) Notice: Subject to any disclaimer, the term of this patent is extended or adjusted under 35 U.S.C. 154(b) by 0 days.

(21) Appl. No.: 14/138,674

(22) Filed: Dec. 23, 2013

(65) Prior Publication Data

US 2015/0013582 A1 Jan. 15, 2015

(30) Foreign Application Priority Data

Jul. 10, 2013 (JP) ..... 2013-145028

(51) Int. Cl.
*D05B 87/02* (2006.01)
*D05B 47/04* (2006.01)

(52) U.S. Cl.
CPC ..... *D05B 87/02* (2013.01); *D05B 47/04* (2013.01)

(58) Field of Classification Search
CPC ..... D05B 87/02; D05B 47/04
USPC ..... 112/225, 302, 254; 223/99; 66/90
See application file for complete search history.

(56) References Cited

U.S. PATENT DOCUMENTS

| | | | | |
|---|---|---|---|---|
| 22,934 | A * | 2/1859 | Burlingame | 223/99 |
| 2,067,476 | A * | 1/1937 | Chason | 223/99 |
| 3,250,447 | A * | 5/1966 | Larew | 223/99 |
| 4,832,240 | A * | 5/1989 | Dalbo | 223/99 |
| 5,003,899 | A | 4/1991 | Ogawa | |
| 6,742,466 | B2 * | 6/2004 | Sano et al. | 112/470.01 |
| 2002/0157586 | A1 * | 10/2002 | Wacker | 112/225 |
| 2003/0019410 | A1 | 1/2003 | Sano et al. | |
| 2005/0022709 | A1 * | 2/2005 | Yoshikazu | 112/225 |
| 2010/0071603 | A1 | 3/2010 | Miyoshi | |

FOREIGN PATENT DOCUMENTS

| | | | |
|---|---|---|---|
| EP | 0270780 | A2 | 6/1988 |
| JP | H08173676 | A | 7/1996 |

OTHER PUBLICATIONS

European Patent Office extended search report dated Apr. 8, 2014.

* cited by examiner

*Primary Examiner* — Ismael Izaguirre
(74) *Attorney, Agent, or Firm* — Nath, Goldberg & Meyer; Jerald L. Meyer; Stanley N. Protigal

(57) ABSTRACT

A needle threader includes a needle bar supporter to which a needle bar holding a needle with a needle hole is attached, a threader shaft supported in a movable manner in a vertical direction and in a rotatable manner, a thread holding mechanism and a threader mechanism which is held by the threader shaft and which comprises a threader hook. The threader hook includes a capturing portion that captures the thread at a tip part of the capturing portion. The capturing portion includes a thread pathway and a thread capturing space. A width of a part where the thread pathway becomes the narrowest is formed so as to be narrower than a width of the thread capturing space. The thread enters or leaves the thread pathway in a tensioned condition, and the width of the part where the thread pathway becomes the narrowest is formed.

6 Claims, 22 Drawing Sheets

(a)

(b)

(a)

(b)

(c)

NEEDLE THREADER OF SEWING MACHINE AND SEWING MACHINE

BACKGROUND OF THE INVENTION

1. Field of the Invention

The subject matter of the present disclosure relates to a needle threader of a sewing machine which inserts a sewing machine thread into a needle hole of a sewing needle, and the sewing machine.

2. Description of the Related Art

Various needle threaders have been proposed to thread a sewing needle of a sewing machine. For example, JP H08-173676 A discloses a needle threader that includes a threader hook having a hooky part formed at a tip thereof to capture a thread. This threader hook captures a thread tensioned by a thread holding mechanism near the needle hole of a needle, and is retracted from the needle hole, thereby performing a needle threading operation.

In the needle threader, the threader hook retracted from the needle hole is moved upwardly with respect to the needle hole in order to further surely draw the thread from the needle hole. Through this upward motion, the thread is released from the hooky part of the threader hook due to frictional force at the needle hole and the weight of the thread itself, and the needle threading operation completes.

When, however, the hook captures the thread, the tension of the thread tensioned by the thread holding mechanism near the needle hole becomes eased. Next, when the hook capturing the thread is retracted from the needle hole, since the thread is released from the thread holding mechanism, the tension of the thread rapidly decreases. Hence, when the hook is retracted from the needle hole, the thread may be released from the hooky part of the hook, and the needle threading operation may complete with the thread being only slightly drawn from the needle hole.

The thread only slightly drawn from the needle hole remains near the needle hole. Accordingly, it is necessary for a user of a sewing machine to complete the needle threading operation by pinching the thread near the needle hole and by drawing it. Hence, the needle threading operation is a bothersome operation for the user. In addition, when attempting to pinch the thread near the needle hole, it is difficult for the user to pinch the thread without touching the needle, and thus a safety is a remarkable technical problem in this case.

The present disclosure has been made in order to address the above-explained technical problems of conventional technologies, and an objective is to provide a needle threader of a sewing machine and the sewing machine which can surely draw a thread from a needle hole.

SUMMARY OF THE INVENTION

To accomplish the above objective, an aspect of the present disclosure provides a needle threader of a sewing machine, and the needle threader includes: a needle bar supporter to which a needle bar holding a needle with a needle hole is attached; a threader shaft supported in a movable manner in a vertical direction and in a rotatable manner; a thread holding mechanism which is held by the threader shaft and which applies a tension to a thread so as to be substantially horizontal ahead of the needle hole; and a threader mechanism which is held by the threader shaft and which comprises a hook that enters the needle hole upon a rotation of the threader shaft. The hook comprises a capturing portion that captures the thread at a tip part of the capturing portion. The capturing portion comprises a thread pathway where the thread enters or leaves, and a thread capturing space for capturing the thread. A width of a part where the thread pathway becomes the narrowest is formed so as to be narrower than a width of the thread capturing space.

The thread may enter or leave the thread pathway in a tensioned condition, and the width of the part where the thread pathway becomes the narrowest may be formed so as to be narrower than an outer diameter of the thread not in a tensioned condition.

A convexity may be provided in the thread pathway. The hook may have a tip formed in a hooky shape, the thread pathway may be formed at a basal part of the hooky shape and a tip part thereof, and the convexity may be provided at the basal part or the tip part.

The hook may be provided in a movable manner in the vertical direction, and the convexity may have a tip part provided so as to be directed in a direction in which the hook moves. The convexity may be formed in a rounded shape.

In order to accomplish the above objective, another aspect of the present disclosure provides a sewing machine that includes the needle threader of the foregoing aspect.

According to the present disclosure, a needle threader of a sewing machine and the sewing machine which can surely draw a thread from a needle hole are provided.

DETAILED DESCRIPTION OF THE PREFERRED EMBODIMENTS

1. First Embodiment

An explanation will be given of an embodiment of the present disclosure applied to a sewing machine. Note that the present disclosure is applicable to various sewing machines, such as a lockstitch sewing machine and a multi-needle sewing machine, and is also applicable to sewing machines available currently and in future. In the following explanation, a direction in which a user is located with respect to a sewing machine will be explained as a front, and a horizontal direction as viewed from the user will be explained as a horizontal direction in some cases. Moreover, a side at which a thread is supplied will be explained as an upper side in some cases.

[1-1. Structure]

Figure 1:
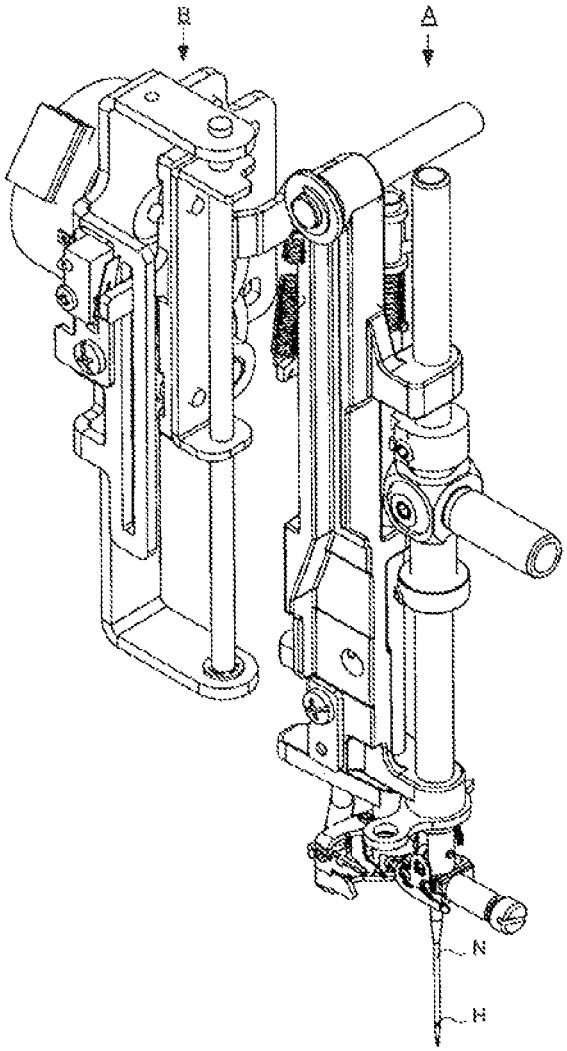
FIG. 1 is a perspective view illustrating a needle threader with a thread holding mechanism according to an embodiment, and a motor unit that is an actuator of the needle threader.

A detailed explanation will be given of an embodiment of the present disclosure with reference to the accompanying drawings. First, the whole structure of a needle threader A of a sewing machine will be explained with reference to FIGS. 1 to 3. As illustrated in FIG. 1, the needle threader A is provided with a motor unit B. In this embodiment, the needle threader A will be explained as being actuated by the motor unit B. The actuation mechanism of the needle threader A is not limited to the motor unit B, and other actuation mechanisms are applicable, and, the needle threader A may be actuated by hand.

Figure 2:
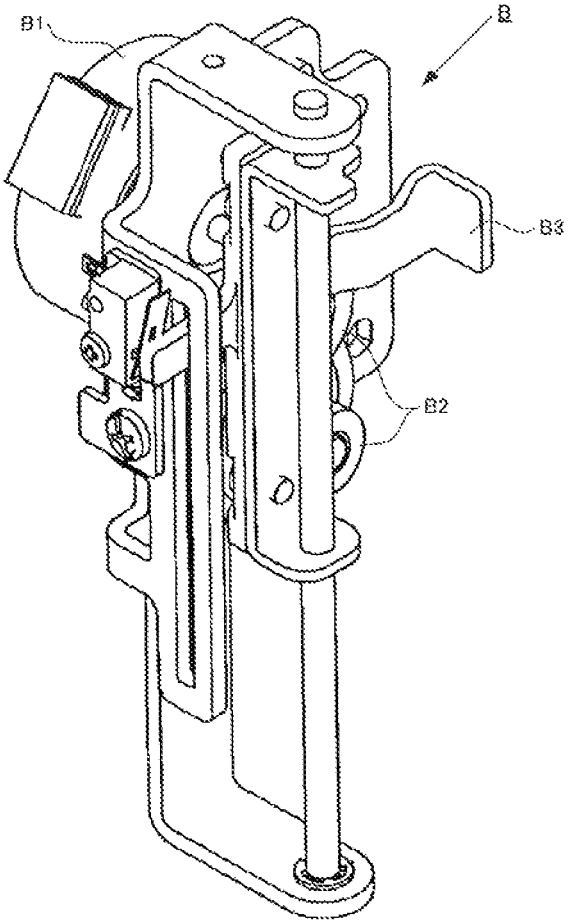
FIG. 2 is a perspective view illustrating the motor unit that actuates the needle threader.

The motor unit B is a mechanism that actuates the needle threader A, and as illustrated in FIG. 2, includes a motor B1, gears B2, and an arm B3. The arm B3 is provided in a movable manner in a vertical direction upon transmission of the rotational motion of the motor B1 through the gears B2. The tip of the arm B3 is linked with a lever 24 of the needle threader A to be discussed later. The needle threader A has the lever 24 to be discussed later linked with the arm B3, thereby performing a needle threading operation in synchronization with the vertical motion of the arm B3.

Figure 3:
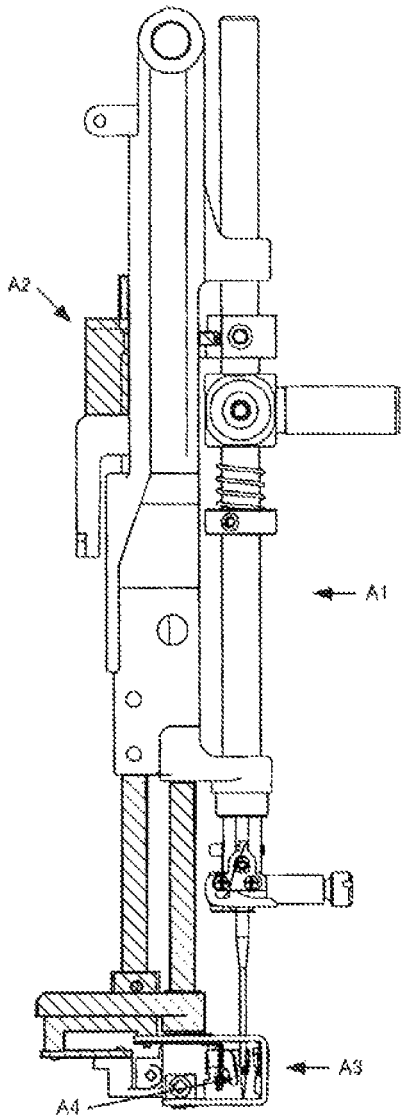
FIG. 3 is a front view illustrating the structure of each mechanism of the needle threader.

The needle threader A performs an operation of threading a needle hole H of a needle N, and as illustrated in FIG. 3, includes a needle bar supporter unit A1, a threader shaft unit A2, a thread holding mechanism A3, and a threader mechanism A4. The threader shaft unit A2 is illustrated by dashed line in FIG. 3. The structure of each component will be explained in detail with reference to FIGS. 4 to 16.

(1) Needle Bar Supporter Unit A1

The needle bar supporter unit A1 holds a needle bar 12 having the needle N attached to the tip. As illustrated in FIGS. 4 to 7, the needle bar supporter unit A1 includes a needle bar supporter 10.

(a) Needle Bar Supporter 10

The needle bar supporter 10 supports the needle bar 12, a threader shaft 20, and a guide shaft 21 both to be discussed later in a substantially parallel manner. The needle bar supporter 10 is attached to an unillustrated sewing machine frame, and supports the needle bar 12 in a manner operable in the vertical direction and swingable in a direction (horizontal direction) orthogonal to the cloth feeding direction.

Figure 7:
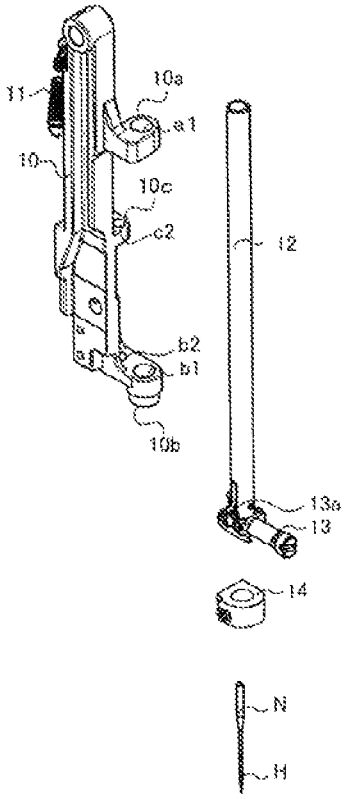
FIG. 7 is an exploded perspective view illustrating a needle bar supporter unit of the needle threader.

As illustrated in FIG. 7, provided at an upper end side of a side face of the needle bar supporter 10 is an upper needle bar supporting part 10*a*. Moreover, provided at a lower end side of the side face of the needle bar supporter 10 at which the upper needle bar supporting part 10*a* is provided is a lower needle bar supporting part 10*b*. The upper needle bar supporting part 10*a* is provided with a needle bar supporting hole a1. The lower needle bar supporting part 10*b* is provided with a needle bar supporting hole b1, a threader shaft supporting hole b2, and a guide shaft supporting hole b3 (illustrated in FIG. 5). The needle bar supporter 10 supports the needle bar 12 through the needle bar supporting hole a1 and the needle bar supporting hole b1.

Provided between the upper needle bar supporting part 10*a* of the needle bar supporter 10 and the lower needle bar supporting part 10*b* thereof is a shaft bearing part 10*c* that supports the threader shaft 20 and the guide shaft 21 to be discussed later. The shaft bearing part 10*c* is provided with a threader shaft supporting hole c2 and a guide shaft supporting hole c3 (illustrated in FIG. 6). The needle bar supporter 10 supports the threader shaft 20 through the threader shaft supporting hole b2 and the threader shaft supporting hole c2, and supports the guide shaft 21 through the guide shaft supporting hole b3 and the guide shaft supporting hole c3.

One end of a spring 11 is attached to a side face of the upper end side of the needle bar supporter 10 opposite to the side face where the upper needle bar supporting part 10*a* is provided. Another end of the spring 11 is attached to the lever 24 of a threader shaft unit A2 to be discussed later.

(b) Needle Bar 12

As illustrated in FIG. 7, the needle bar 12 is a bar-shape member having a tip attached to the needle N. The needle bar 12 has an upper end side inserted in the needle bar supporting hole a1 of the upper needle bar supporting part 10*a*, and has a lower end side inserted in the needle bar supporting hole b1 of the lower needle bar supporting part 10*b*, and is supported by the needle bar supporter 10 in a manner slidable in the vertical direction. Attached to the needle bar 12 are a needle clamp screw 13 and a pin stopper 14.

The needle clamp screw 13 is to fasten and hold the needle N to the needle bar 12, and is provided at a tip (lower end) of the needle bar 12. The needle clamp screw 13 fastens the needle N to the needle bar 12 by screwing in such a way that the needle hole H of the needle N is directed to the sewing direction (back-and-forth direction). Moreover, the needle clamp screw 13 is provided with a thread guide 13*a*. A thread supplied from an unillustrated bobbin that is a thread supply source is guided to the thread guide 13*a*.

The pin stopper 14 restricts the descending position of the thread holding mechanism A3 and the threader mechanism A4. When the thread holding mechanism A3 and the threader mechanism A4 reach a position of the needle hole H of the needle N, the pin stopper 14 abuts a pin 23 of the threader shaft 20 to be discussed later. This stops the descending of the threader shaft 20, the thread holding mechanism A3 and the threader mechanism A4, and causes those to rotate in the circumferential direction of the threader shaft 20. The pin stopper 14 is attached at a location in the needle bar 12 which allows the thread holding mechanism A3 and the threader mechanism A4 to reach the position of the needle hole H upon abutment with the pin 23. The pin stopper 14 includes a stopper protrusion to stop the pin 23, and a holding groove that holds the pin 23 with a play (see FIG. 5).

(2) Threader Shaft Unit A2

The threader shaft unit A2 is linked with the thread holding mechanism A3 and the threader mechanism A4, moves those mechanisms in the vertical direction and rotates those mechanisms. The threader shaft unit A2 is supported by the needle bar supporter 10. The threader shaft unit A2 moves in the vertical direction the thread holding mechanism A3 and the threader mechanism A4 between a height near the needle clamp screw 13 (standby position) and a height that permits to thread the needle hole H of the needle N (threading position). As illustrated in FIGS. 4 to 6 and 8, the threader shaft unit A2 includes the threader shaft 20, the guide shaft 21, and a linking member 22.

(a) Threader Shaft 20

Figure 5:
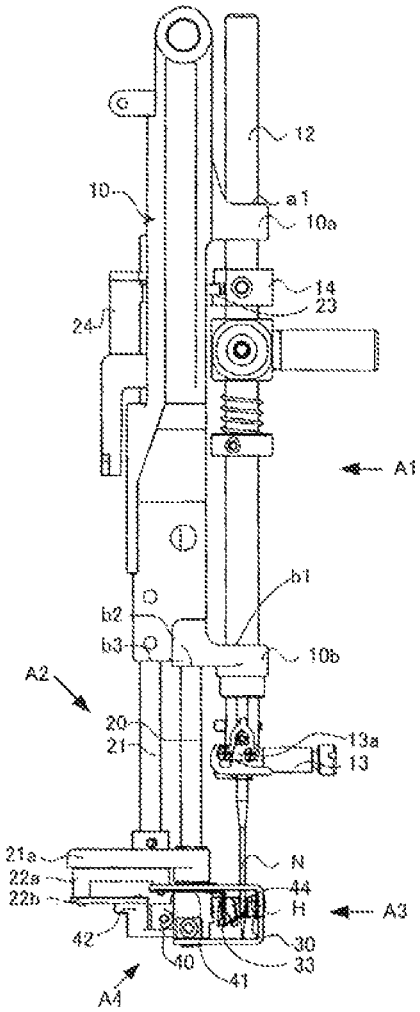
FIG. 5 is a front view illustrating the needle threader.
Figure 6:
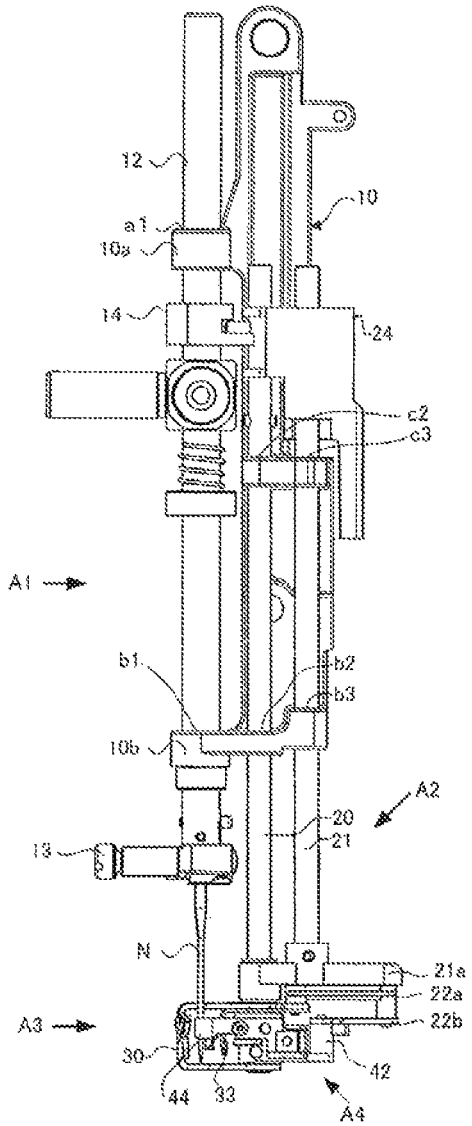
FIG. 6 is a back view illustrating the needle threader.
Figure 8:
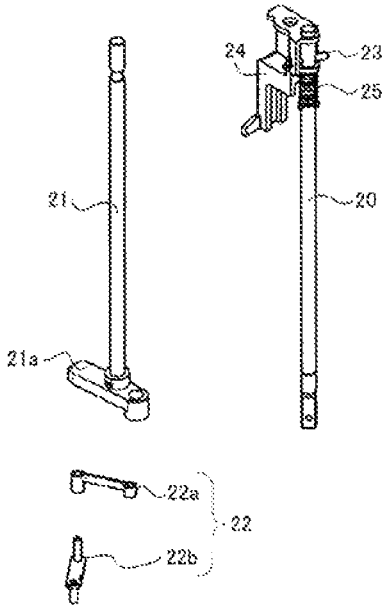
FIG. 8 is an exploded perspective view illustrating a threader shaft unit of the needle threader.

The threader shaft 20 is a bar-shape member that is a shaft to allow the thread holding mechanism A3 and the threader mechanism A4 to move in the vertical direction and to rotate those mechanisms. As illustrated in FIG. 6, the threader shaft 20 has an upper end side inserted in the threader shaft supporting hole c2 of the shaft bearing part 10*c*, and has a lower end side inserted in the threader shaft supporting hole b2 of the lower needle bar supporting part 10*b*, and, is supported by the needle bar supporter 10 in a manner slidable in the vertical direction and rotatable. As illustrated in FIG. 8, the pin 23, the lever 24, and the spring 25 are attached to the threader shaft 20. In addition, as illustrated in FIG. 5, the thread holding mechanism A3 and the threader mechanism A4 are attached to the lower end of the threader shaft 20.

As explained above, the pin 23, by abutting the pin stopper 14 of the needle bar 12, stops the threader shaft 20 descending and rotates the threader shaft 20 in the circumferential direction. The pin 23 is provided at the upper end side of the threader shaft 20. The pin 23 is firmly fastened at the upper end side of the threader shaft 20 in a manner passing all the way through and substantially perpendicular to the lengthwise direction of the threader shaft 20. The pin 23 is provided in such a way that both ends protrude to the exterior from the diametrical direction of the threader shaft 20.

The lever 24 is linked with the arm B3 of the motor unit B, and is moved by the vertical motion of the arm B3. The lever 24 is provided at the upper end side of the threader shaft 20. The lever 24 is formed with a hole into which the upper end side of the guide shaft 21 is inserted. The lever 24 is provided with a cam mechanism that rotates the threader shaft 20.

Figure 4:
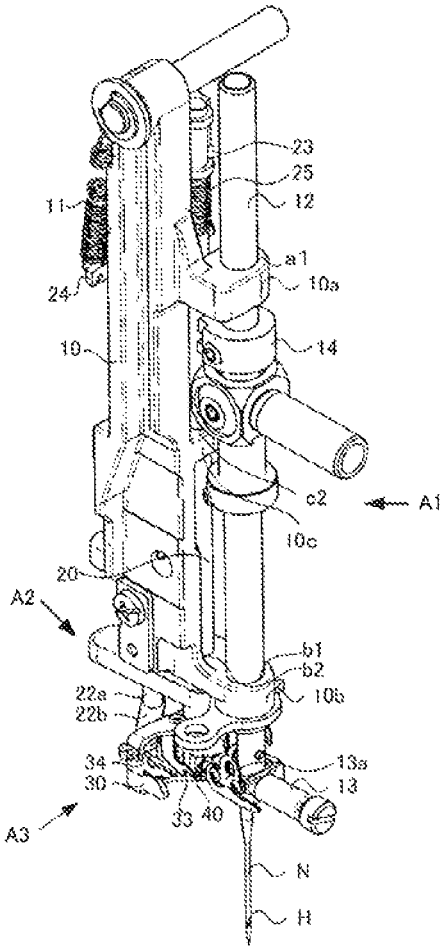
FIG. 4 is a perspective view illustrating the needle threader.

As illustrated in FIG. 4, another end of the spring 11 having the one end attached to the needle bar supporter 10 is attached to the lever 24. Hence, the spring 11 is suspended across the needle bar supporter 10 and the lever 24, and the thread holding mechanism A3 and the threader mechanism A4 linked with the threader shaft unit A2 are pushed upwardly by the spring elastic force of the spring 11.

A spring 25 pushes the threader shaft 20 upwardly, and is attached to the lower part of the pin 23 in the threader shaft 20. Below the pin 23, the spring 25 is attached so as to be located between the shaft bearing part 10*c* of the needle bar supporter 10 and the pin 23. The spring 25 has a role of pushing the threader shaft 20 upwardly by its elastic force upon abutting with the shaft bearing part 10*c*.

(b) Guide Shaft 21

The guide shaft 21 is a bar-shape member that is a guide to rotate the thread holding mechanism A3 in the opposite direction to the rotation direction of the threader shaft 20. As illustrated in FIG. 6, the guide shaft 21 has an upper end side inserted in the guide shaft supporting hole c3 of the shaft bearing part 10*c*, has a lower end side inserted in the guide shaft supporting hole b3 of the lower needle bar supporting part 10*b*, and is supported by the needle bar supporter 10 in a manner slidable in the vertical direction and rotatable. The guide shaft 21 has an upper end attached to the lever 24 of the threader shaft 20, and is moved in the vertical direction and rotated in synchronization with the threader shaft 20. A guide 21*a* with a guide groove formed at the bottom is attached to the lower end of the guide shaft 21. The threader shaft 20 is inserted in one end of the guide 21*a*. The guide 21*a* is linked with the linking member 22.

(c) Linking Member 22

The linking member 22 is to rotate the thread holding mechanism A3 around the threader shaft 20 in the opposite direction to the rotation direction of the threader shaft 20 in synchronization with the rotation of the threader shaft 20. The linking member 22 includes a first link plate 22*a* and a second link plate 22*b*. A pin protruding from the second link plate 22*b* passes all the way through the hole of the first link plate 22*a*, and is fitted in the guide groove of the guide 21*a*. The first link plate 22*a* and the second link plate 22*b* are coupled with the thread holding mechanism A3 and the threader mechanism A4, respectively.

(3) Thread Holding Mechanism A3

Figure 9:
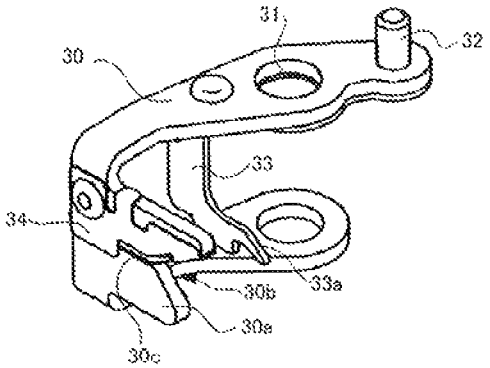
FIG. 9 is a perspective view illustrating a thread holding mechanism of the needle threader.

The thread holding mechanism A3 holds an end side of the thread guided by the thread guide 13*a* of the needle bar 12. As illustrated in FIGS. 4 to 6 and 9 to 11, the thread holding mechanism A3 includes a thread gripper unit 30 provided in a movable manner in the vertical direction and gripping the end of the thread guided by the thread guide 13*a*. As illustrated in FIG. 9, the thread gripper unit 30 is formed with a bearing hole 31 and a pin 32. The thread gripper unit 30 is attached to the lower part of the threader shaft 20 in a rotatable manner upon fastening of the threader shaft 20 with the bearing hole 31. The thread gripper unit 30 is coupled with the first link plate 22*a* by the pin 32. In addition, a thread presser unit 33 and a leaf spring 34 are attached to the thread gripper unit 30.

(a) Thread Gripper Unit 30

Figure 11:
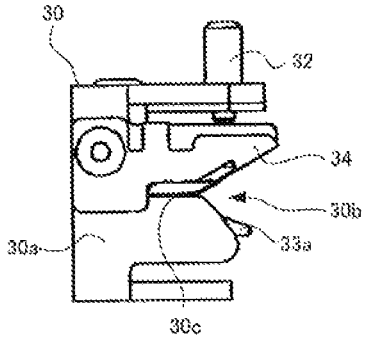
FIG. 11 is a side view illustrating the thread holding mechanism of the needle threader.

The thread gripper unit 30 grips the end of the thread. As illustrated in FIG. 4, the thread gripper unit 30 fastened to the threader shaft 20 has a thread gripper 30*a* bent toward the needle N when the thread holding mechanism A3 is located at the standby position. As illustrated in FIG. 11, the thread gripper 30*a* is formed with a V-shape guide 30*b*. A slit 30*c* with a width that enables pinching of the thread is formed in a manner continuous from the guide 30*b* by notching. The thread is inserted in the slit 30*c* in a slid manner, thereby being pinched by the thread gripper unit 30. The slit 30*c* may be formed so as to make the width narrowed gradually toward the end of the notch and formed as a V-shape slit, thereby holding the thread further firmly.

(b) Thread Presser Unit 33

The thread presser unit 33 abuts the thread guided by the thread guide 13*a* and the thread gripper unit 30. The thread presser unit 33 guides the position of the thread upon abutting with the thread, and applies a tension to the thread. That is, when the thread holding mechanism A3 and the threader mechanism A4 move from the standby position to the threading position, the thread presser unit 33 abuts the thread, and thus the thread is guided so as to be located ahead of the needle hole H of the needle N. Moreover, the thread presser unit 33 abutting the thread applies a tension in such a way that the thread becomes substantially horizontal ahead of the needle hole H.

Figure 10:
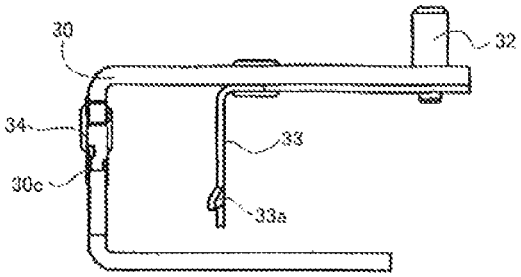
FIG. 10 is a front view illustrating the thread holding mechanism of the needle threader.

The thread presser unit 33 is provided so as to maintain a predetermined positional relationship with the thread gripper unit 30. As illustrated in FIGS. 9 and 10, the thread presser unit 33 is formed between the bearing hole 31 and the thread gripper unit 30. Accordingly, when the thread holding mechanism A3 is fitted with the threader shaft 20, the thread presser unit 33 is provided between the thread gripper unit 30 and the thread guide 13*a* that is a thread supply side.

The thread presser unit 33 is an L-shape tabular member when viewed from the thread-gripper-30*a* side and provided substantially parallel with the thread gripper 30*a*. That is, the thread presser unit 33 includes a plane to be attached to the thread gripper unit 30, and a plane orthogonal with the former plane and abuts the thread. Yet, the shape of the thread presser unit 33 is not limited to the L-shape, and a rectangular thread presser unit 33 may have a lower face abutting the thread.

The lower face of the thread presser unit 33 may be provided so as to be substantially in parallel with the guide 30*b* of the thread gripper unit 30 which is the thread gripping position. More preferably, as illustrated in FIGS. 10 and 11, the lower face of a presser bar 33*a* may be provided so as to be below the position of the guide 30*b* of the thread gripper unit 30. The thread presser unit 33 is provided so as to maintain the above-explained positional relationship with the thread gripper unit 30, thereby abutting the thread.

The thread presser unit 33 has the presser bar 33*a* formed so as to run from the end of the surface abutting the thread in the horizontal direction. The presser bar 33*a* initially abuts the thread when the thread gripper unit 30 is descended downwardly with respect to the thread guide 13*a*. Moreover, the lower face of the presser bar 33*a* is formed as an inclined face inclined downwardly toward the tip.

(c) Leaf Spring 34

Figure 12A:
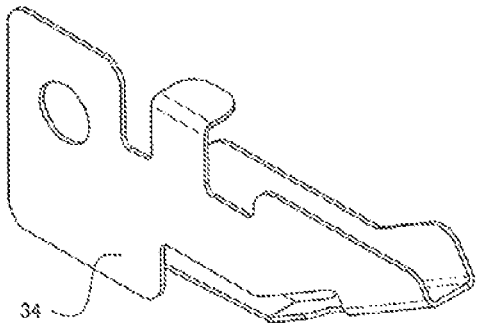
FIG. 12A is a perspective view illustrating a leaf spring to be attached to the thread holding mechanism of the needle threader.
Figure 12B:
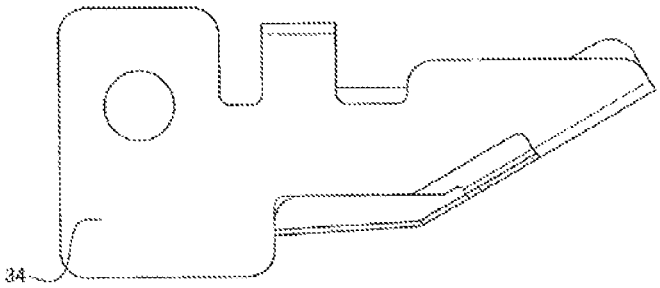
FIG. 12B is a side view illustrating the leaf spring to be attached to the thread holding mechanism of the needle threader.

The leaf spring 34 applies a tension to the thread gripped by the thread gripper unit 30, and is attached to the thread gripper unit 30. As illustrated in FIG. 12, the leaf spring 34 is attached to a face located upwardly between the opposing faces forming the guide 30*b* and the slit 30*c* in the vertical direction. The face located above will be defined as an upper face, while the opposing face located below will be defined as a lower face.

Figure 13A:
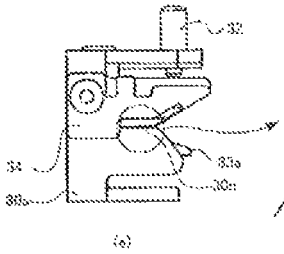
FIG. 13A is a side view illustrating the leaf spring attached to the thread holding mechanism of the needle threader.
Figure 13B:
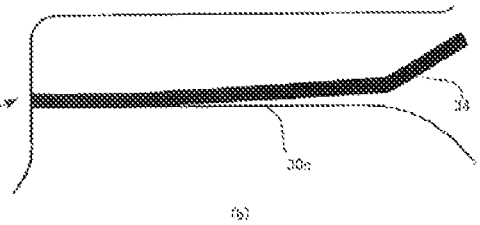
FIG. 13B is an enlarged view illustrating a part surrounded by a circle in FIG. 13A.

As illustrated in FIG. 13 that is an enlarged view, the leaf spring 34 is attached so as to cover the upper face forming the guide 30*b* and the slit 30*c*. The leaf spring 34 may be machined in accordance with the shape of the upper face of the slit 30*c* when the slit 30*c* is formed in a V-shape. The slit 30*c* may be simply a notch, and a V-shape slit 30*c* may be formed by providing an inclined face in the upper face of the leaf spring 34.

The leaf spring 34 is directed downwardly. Hence, when the thread is guided by the slit 30*c*, the leaf spring 34 is directed in a direction pushing the thread. This pushing force allows the thread gripped by the thread gripper unit 30 to be further firmly held, and increases the tension of the thread tensioned at the threading position. The member that applies a tension to the thread is not limited to the leaf spring, and an elastic member like a rubber may be utilized. In addition, a tension applying member may be attached to the lower face forming the guide 30*b* and the slit 30*c* to push the thread upwardly.

(4) Threader Mechanism A4

The threader mechanism A4 is to allow the thread guided by the thread guide 13*a* and the thread gripper unit 30 to pass through the needle hole H of the needle N. As illustrated in FIGS. 4 to 6, the threader mechanism A4 and the thread holding mechanism A3 are provided so as to face with each other with the threader shaft 20 being present therebetween. As will be explained later, the threader mechanism A4 allows the thread held by the thread holding mechanism A3 ahead of the needle N to enter the thread hole H from the back of the needle N and to be hooked, thereby allowing the thread to pass through the needle hole H.

The threader mechanism A4 includes a hook holder 40 that couples the threader shaft 20 with the threader mechanism A4. As illustrated in FIGS. 4 and 5, the hook holder 40 includes a bearing hole 41 and a linking hole 42. The hook holder 40 is attached to the lower part of the threader shaft 20 in a unified manner so as to rotate in the same direction as the rotation direction of the threader shaft 20 by fastening the threader shaft 20 in the bearing hole 41. The hook holder 40 is coupled with the second link plate 22*b* through the linking hole 42. In addition, a threader hook 43 and two guide plates 44 are attached to the hook holder 40.

(a) Threader Hook 43

Figure 14:
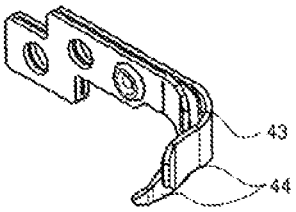
FIG. 14 is a perspective view illustrating a threader mechanism of the needle threader.
Figure 15:
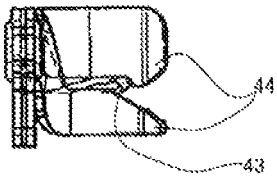
FIG. 15 is a front view illustrating the threader mechanism of the needle threader.
Figure 16:
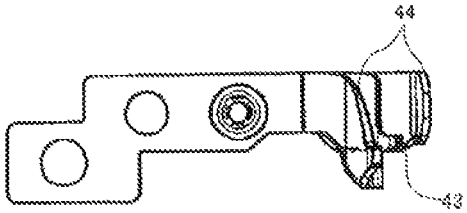
FIG. 16 is a side view illustrating the threader mechanism of the needle threader.

As illustrated in FIGS. 14 to 16, the threader hook 43 hooks up the thread through a hooky part, and allows the thread to pass through the needle hole H. The threader hook 43 is rotated together with the hook holder 40 upon rotation of the threader shaft 20, and enters the needle hole H of the needle N. The threader hook 43 is formed in a hooky shape having a tip that can enter the needle hole H of the needle N.

Figure 17:
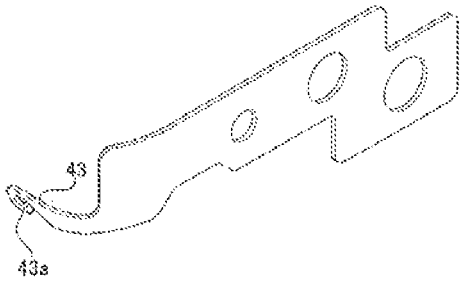
FIG. 17 is a perspective view illustrating a threader hook of the threader mechanism.
Figure 18:
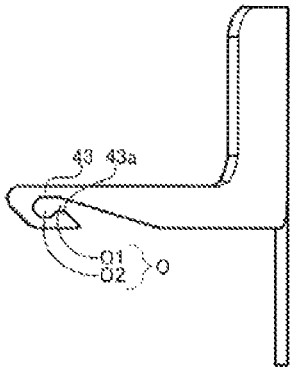
FIG. 18 is a side view illustrating the threader hook of the threader mechanism.

FIGS. 17 to 20 illustrate an example threader hook 43 used for the needle threader A of this embodiment. As illustrated in FIG. 18, the threader hook 43 includes a capturing portion O which is formed at a tip part and which captures the thread. This capturing portion O includes a thread pathway O1 where the thread enters or leaves, and a thread capturing space O2 that holds the thread captured by the threader hook 43. The thread pathway O1 is formed in such a way that a width of a part where the thread pathway O1 becomes the narrowest is narrower than the width of the thread capturing space O2. It is appropriate if the thread capturing space O2 has a width that can sufficiently hold the thread.

As will be explained later, the threader hook 43 captures the tensioned thread. That is, the tensioned thread passes through the thread pathway O1. In this case, the thread pathway O1 may be formed in such a way that the width of a part where the thread pathway O1 becomes the narrowest is narrower than the outer diameter of the thread not in a tensioned condition. That is, the length in the direction orthogonal to the center axis of the thread captured by the threader hook 43 is formed so as to be shorter than the outer diameter of the thread not in a tensioned condition.

The width of a part where the thread pathway O1 becomes the narrowest can be designed as needed in accordance with the thickness of the thread captured by the threader hook 43. However, as will be explained later, it is preferable that such a width should be designed so as to allow the tensioned thread to enter or leave, and to prevent the thread with a tension eased from releasing from the thread capturing space O2.

An example threader hook 43 illustrated in FIGS. 17 to 20 is the threader hook 43 having the above-explained thread pathway O1 formed with a convexity. The convexity formed in the thread pathway O1 serves to narrow down the width of the thread pathway O1. In the case of the threader hook 43 illustrated in FIGS. 17 to 20, the thread pathway O1 is formed at the basal part of the hooky shape forming the threader hook 43 and the tip part thereof.

Figure 19:
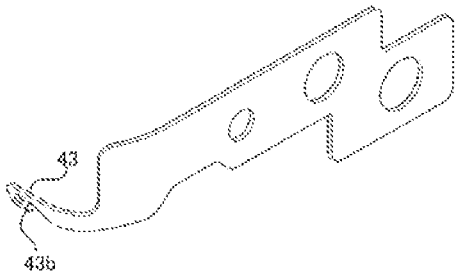
FIG. 19 is a perspective view illustrating the threader hook of the threader mechanism.
Figure 20:
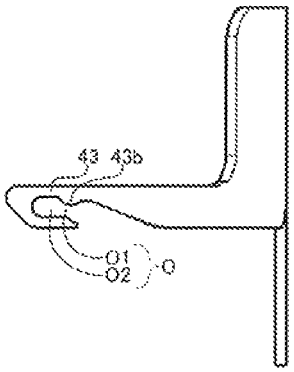
FIG. 20 is a side view illustrating the threader hook of the threader mechanism.

Moreover, FIGS. 17 and 18 illustrate the threader hook 43 having a convexity 43*a* formed at a tip part of a hooky shape forming the threader hook 43. In addition, FIGS. 19 and 20 illustrate the threader hook 43 having a convexity 43*b* formed at a basal part of the hooky shape forming the threader hook 43. In the thread pathway O1, convexities may be formed on both opposing faces, i.e., the tip part of the hooky shape and the basal part thereof to narrow down the width of the thread pathway O1.

As will be explained later, the threader hook 43 is moved in the vertical direction in the needle hole H when retracted therefrom while capturing the thread. In this case, it is preferable that the convexity should be provided in such a way that the tip part thereof is directed in the moving direction of the threader hook 43. The tip part of the convexity means the vertex thereof when the convexity is in a semi-circular shape, and means a top when the convexity is in a rectangular shape.

As will be explained later, when, for example, the threader hook 43 is moved upwardly while capturing the thread, it is preferable that the convexity should be provided at the tip part of the hooky shape forming the threader hook 43. When the convexity is provided at the tip part of the hooky shape, a convexity is provided at a part facing with the moving direction of the threader hook 43, i.e., a lower face between faces forming the thread pathway O1. Even when the threader hook 43 is moved upwardly, the convexity may be provided at the basal part of the hooky shape.

In addition, the convexity may be formed in a rounded shape. When rounded, it becomes possible to prevent the convexity from damaging the thread when entering or leaving. The term rounded shape means a curved shape having no angle. The curved shape is not limited to an arc shape of a true circle, and a shape can be deemed as a curved shape if having no angle. In particular, it is preferable that a part that contacts the thread entering or leaving the thread pathway O1 should be formed in a rounded shape so as to prevent the thread from being held by the convexity when entering or leaving.

(b) Guide Plates 44

The guide plates 44 guide the thread in the vertical direction to a position appropriate for the threader hook 43 to capture the thread when the thread is disposed ahead of the needle hole H of the needle N. As illustrated in FIG. 16, the guide plates 44 are provided so as to hold the threader hook 43 therebetween, and like the threader hook 43, are rotated together with the hook holder 40 in accordance with the rotation of the threader shaft 20.

[1-2. Operation]

An explanation will be given of an example needle threading operation of the needle threader A including the thread holding mechanism A3 as explained above. First, an explanation will be given of a thread guiding operation by the user. The thread guiding operation is carried out with the thread holding mechanism A3 and the threader mechanism A4 being located at the standby position.

With respect to the thread guided drawn from the bobbin to the proximity of the needle bar 12, the thread guiding operation carried out by the user of the sewing machine includes the following two procedures:

(1) Guide the thread to the thread guide 13*a* of the needle bar 12.

(2) Guide the end side of the thread guided by the thread guide 13*a* to the thread gripper unit 30.

In the above-explained procedure (2), the slit 30*c* of the thread gripper unit 30 is formed in such a way that the width of such a slit becomes narrower toward the end of the notch, and thus the thread is surely held. In addition, the leaf spring 34 pushes downwardly the held thread, thereby increasing the certainty of holding the thread.

Figure 21:
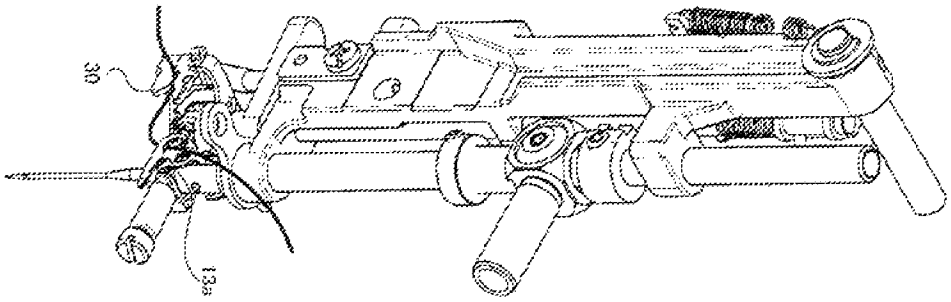
FIG. 21 is a perspective view illustrating a condition in which a thread guiding operation by a user completes in the needle threader.
Figure 22:
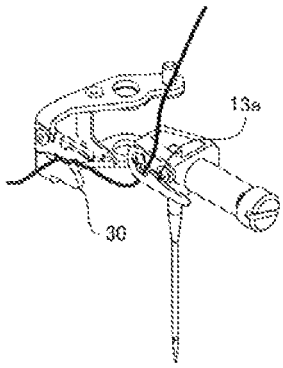
FIG. 22 is a partial enlarged view illustrating a condition in which the thread guiding operation by the user completes.

FIGS. 21 and 22 illustrate the needle threader A having the thread guided by the thread guide 13*a* and the thread gripper unit 30. As is clear from the partial enlarged view of FIG. 18, the thread is guided by only two positions that are the thread guide 13*a* and the thread gripper unit 30, thus no tension is applied yet.

Next, an explanation will be given of a needle threading operation by the needle threader A. The motor B1 of the motor unit B is actuated and the arm B3 is descended. In this case, the lever 24 linked with the arm B3 is moved downwardly against the force by the spring 11 attached to the lever 24. The lever 24 is also linked with the threader shaft 20 and the guide shaft 21, and thus the threader shaft 20 and the guide shaft 21 are also descended.

Figure 23:
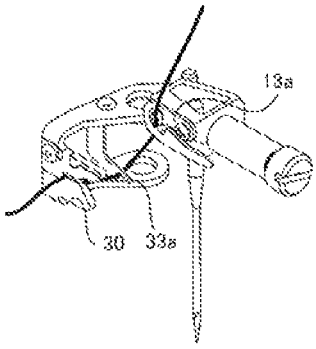
FIG. 23 is a partial enlarged view illustrating a condition in which a thread presser unit abuts a thread.

The thread holding mechanism A3 and the threader mechanism A4 are attached to the threader shaft 20. Hence, the thread holding mechanism A3 and the threader mechanism A4 are also moved downwardly. In this case, as illustrated in FIG. 23, when the thread holding mechanism A3 starts descending, the lower face of the presser bar 33*a* of the thread presser unit 33 located between the thread guide 13*a* and the thread gripper unit 30 abuts the thread guided by the thread guide 13*a* and the thread gripper unit 30.

Hence, the thread presser unit 33 applies a tension to the thread guided by the thread guide 13*a* and the thread gripper unit 30. When the lower face of the thread presser unit 33 is provided below the thread gripping position of the thread gripper unit 30, in comparison with a case in which the lower face of the thread presser unit 33 is located at the same height as that of the thread gripping position, a further stronger tension is applied. In addition, since the tip of the presser bar 33*a* is inclined downwardly, the thread is guided to the basal end of the presser bar 33*a* that is the thread pressing position without being detached from the thread presser unit 33.

Figure 24:
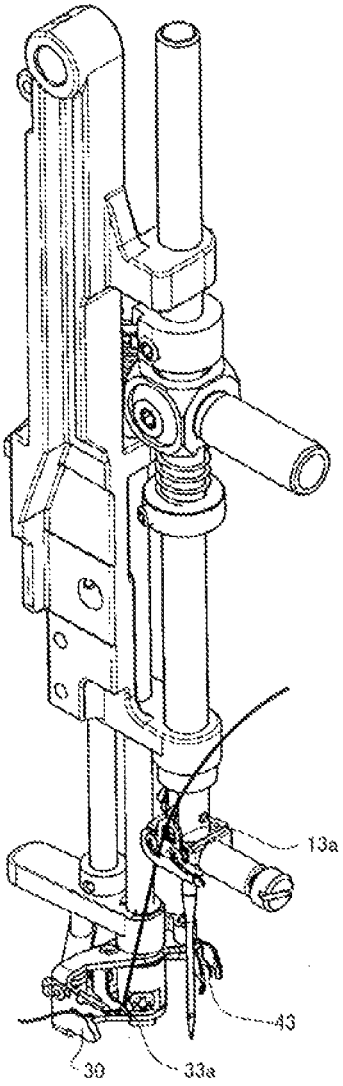
FIG. 24 is a perspective view illustrating the thread holding mechanism and the threader mechanism descended near a needle hole in the needle threader.

The lever 24 is further moved downwardly by the motor unit B at a position where the thread holding mechanism A3 and the threader mechanism A4 can let the thread to pass through the needle hole H of the needle N. As illustrated in FIG. 24, when the thread holding mechanism A3 is descended to the threading position, the thread guided by the thread guide 13*a* and the thread gripper unit 30 is guided by the thread presser unit 33 so as to be located ahead of the needle hole H of the needle N with a clearance. In addition, the thread is tensioned substantially horizontally by the thread presser unit 33 ahead of the needle hole H, thus maintaining a sufficient tension for the needle threading operation.

In the thread supplying path from the unillustrated bobbin, the thread is guided by multiple guides, and thus the thread has a drag at the thread supplying side. Accordingly, when the thread presser unit 33 abuts and pushes the thread guided by the thread guide 13*a* and the thread gripper unit 30, the thread becomes able to maintain a sufficient tension for the needle threading operation ahead of the needle hole H. Moreover, since the thread guided by the thread gripper unit 30 is pushed downwardly by the leaf spring 34, a tension is applied to the thread, and thus a tensioned condition of the thread is further surely maintained.

When the thread holding mechanism A3 and the threader mechanism A4 descend to the threading position, the pin 24 of the threader shaft 20 abuts the stopping protrusion of the pin stopper 14 of the needle bar 12, thus those mechanisms stop descending. In this condition, when the lever 24 is further moved downwardly, the pin 23 is rotated by the cam mechanism provided at the lever 24. Hence, the threader shaft 20 is rotated.

Figure 25A:
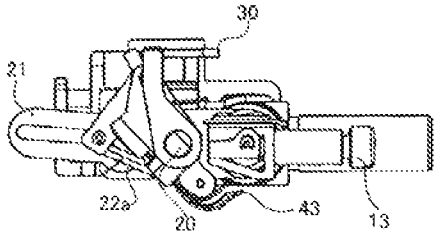
FIG. 25 A-C are plan views illustrating a needle threading operation by the thread holding mechanism and the threader mechanism in the needle threader.
Figure 25B:
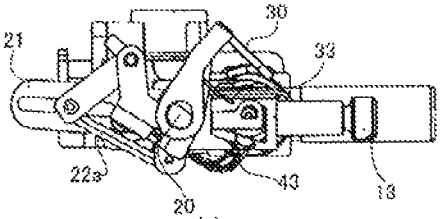
Figure 25C:
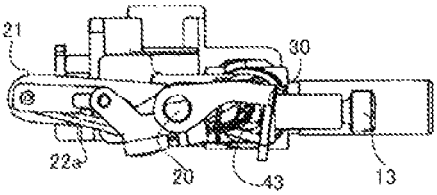
Figure 26:
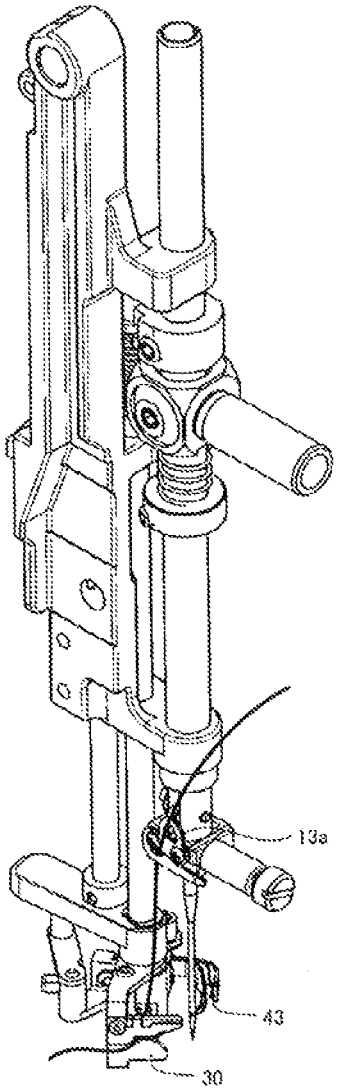
FIG. 26 is a perspective view illustrating the rotating thread holding mechanism and threader mechanism in the needle threader.

As illustrated in FIGS. 25 and 26, upon rotation of the threader shaft 20, the threader mechanism A4 attached to the threader shaft 20 starts rotating, and the thread holding mechanism A3 also starts rotating. The threader mechanism A4 has the hook holder 40 rotated in the same direction as the rotation direction of the threader shaft 20. Upon this rotation, the hook holder 40 is rotated in the forward direction, and thus the threader hook 43 is inserted in the needle hole H of the needle N.

The thread holding mechanism A3 rotates in the opposite direction to the rotation direction of the threader shaft 20 by the linking member 22 that moves along the guide groove of the guide 21*a*. Upon this rotation, the thread holding mechanism A3 is rotated in the backward direction. Hence, the thread guided by the thread guide 13*a* and the thread gripper unit 30 and which has a tension applied to such a thread upon abutting of the thread presser unit 33 is moved ahead of the needle hole H of the needle N.

Figure 27:
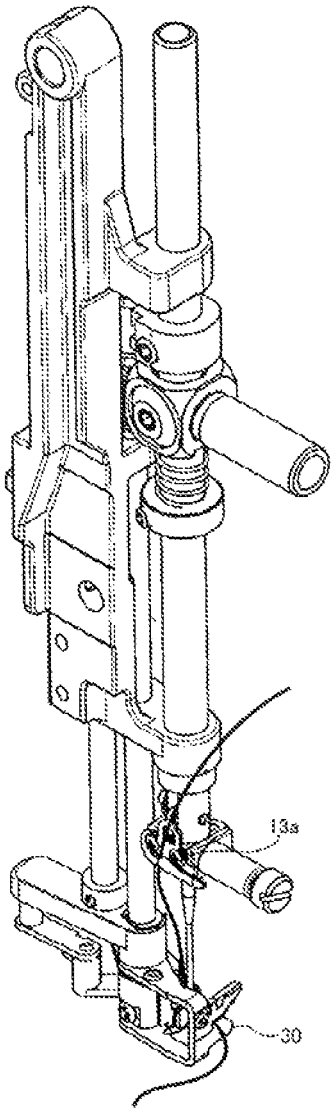
FIG. 27 is a perspective view illustrating the threader mechanism capturing an thread in the needle threader.
Figure 28:
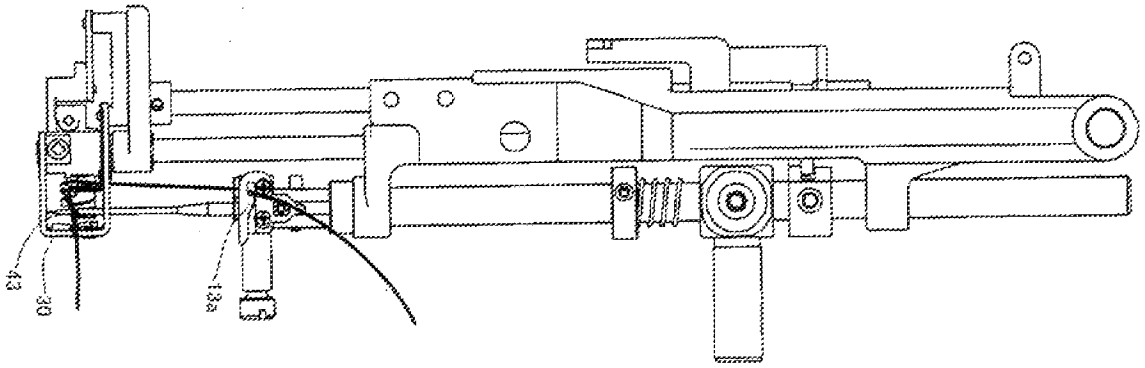
FIG. 28 is a side view illustrating the threader mechanism capturing the thread in the needle threader.

In this case, as illustrated in FIGS. 26 to 28, the hooky tip of the threader hook 43 of the threader mechanism A4 inserted in the needle hole H from the back thereof captures the thread held by the thread holding mechanism A3 ahead of the needle hole H. At this time, the thread maintaining the tensioned condition by the thread holding mechanism A3 is guided by the guide plates 44 of the threader mechanism A4 so as to be located at a position appropriate for the threader hook 43 to capture the thread, i.e., guided so as to be horizontal ahead of the needle hole H.

Since the thread maintains a tension by the thread holding mechanism A3, the outer diameter of the thread is smaller than that of the thread not in a tensioned condition. Accordingly, since the thread is guided to the thread capturing space O2 through the thread pathway O1 formed so as to be narrower than the outer diameter of the thread not in a tensioned condition, the thread is captured by the threader hook 43. In addition, when the convexity provided in the thread pathway O1 is in a rounded shape, it becomes possible to prevent the thread from being damaged when captured by the threader hook 43.

Next, the force by the motor unit B applied to the lever 24 is released, and the threader shaft 20 and the guide shaft 21 are pushed upwardly by the elastic forces by the springs 11 and 25. In this case, the thread holding mechanism A3 and the threader mechanism A4 are moved in the opposite direction when the threader shaft 20 and the guide shaft 21 descend. That is, the threader mechanism A4 is rotated in the backward direction, and is retracted from the needle hole H with the threader hook 40 capturing the thread, and thus the needle threading operation of the thread with respect to the needle hole H of the needle N is carried out.

When the lever 24 is further moved upwardly, the thread holding mechanism A3 and the threader mechanism A4 ascend. In this case, while moving upwardly after rotated in the forward direction, the thread holding mechanism A3 releases the thread from the thread gripper unit 30. Although the guide 30*b* of the thread gripper unit 30 is firmly holding the thread, the thread has a held direction changed when the thread holding mechanism A3 is rotated in the forward direction with the thread captured by the threader hook 40, and becomes likely to be easily released from the guide 30*b*. In addition, the guide 30*b* in the V-shape has the width that becomes wider from the end part of the notch to the origin part, and thus the thread is smoothly released when the thread holding mechanism A3 moves in the direction in which the thread is released.

When the lever 24 is moved upwardly, the threader mechanism A4 is moved upwardly with the threader hook 43 capturing the thread. When the threader hook 43 pulls up the thread, the thread is released from the thread holding mechanism A3. Hence, the thread holding mechanism A3 releases the thread after completing threading the needle hole H of the needle N, and thus the length of the thread drawn from the needle hole H becomes long.

When the threader hook 43 is moved upwardly, a downward tension is applied to the thread due to friction applied to the thread in the needle hole H and the weight of the thread itself. At this time, when the tip part of the convexity 43*a* of the threader hook 43 is provided so as to be directed upwardly with respect to the threader hook 43 that is moved upwardly, it becomes possible to effectively prevent the thread pulled downwardly from being released from the thread pathway O1.

Figure 29:
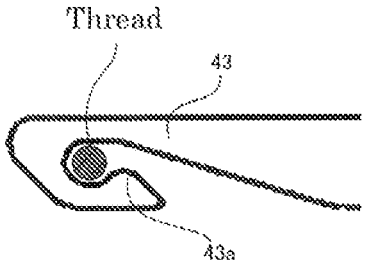
FIG. 29 is an enlarged view illustrating the threader hook capturing the thread in the needle threader.

After the threader hook 43 captures the thread, the tension of the thread becomes eased, and when the thread is released from the thread holding mechanism A3, the tension of the thread sharply decreases. When the tension of the thread is eased, the outer diameter of the thread gradually expands. That is, when the tension of the thread is eased, the outer diameter of the thread becomes larger than the width of the thread pathway O1. Hence, after the tension of the thread becomes eased, it becomes possible to prevent the thread from being released from the thread pathway O1. That is, as illustrated in FIG. 29, a time at which the thread remains in the thread capturing space O2 becomes long. Accordingly, the thread is drawn by the threader hook 43 without being left near the needle hole H. As explained above, the needle threading operation by the needle threader A of this embodiment completes, and the thread holding mechanism A3 and the threader mechanism A4 return to the standby position. Next, while the threader mechanism A4 ascends to the proximity of the standby position, the thread is released from the threader hook 43.

[1-3. Advantageous Effects]

The needle threader A of this embodiment employing the above-explained structure has the following advantages.

(1) Since the width of a part where the thread pathway O1 becomes the narrowest is formed so as to be narrower than the width of the thread capturing space O2, the thread held in the thread capturing space O2 is not likely to be released from the threader hook 43. Hence, the thread can be surely drawn from the needle hole H.

(2) When the thread pathway O1 is formed so as to be narrower than the outer diameter of the thread not in a tensioned condition, the thread can be further surely captured through the needle threading operation, and the thread is prevented from being released from the threader hook 43. Hence, the thread is not likely to be left near the needle hole H, and the needle threading operation can complete further surely. Accordingly, it is unnecessary for the user to draw the thread, and the user can easily complete the needle threading operation. In addition, the possibility that the user touches the needle N can be reduced, and thus the safeness of the needle threading operation can be enhanced. Still further, the frequency that the user touches the needle N can be reduced, and thus the deterioration of the needle N like rusting can be prevented.

(3) In addition, the structure having the convexity provided in the thread pathway O1 prevents the thread from being released from the hook without a further member. Hence, when the needle threader of this embodiment is applied to a conventional sewing machine, such a sewing machine can accomplish the advantageous effects of (1) and (2) above.

(4) In the threader hook 43, since the tip of the convexity is provided so as to be directed in the direction in which the threader hook 43 moves, it becomes possible to further effectively prevent the thread from being released from the threader hook 43 due to frictional force in the needle hole H and the weight of the thread itself.

(5) When the convexity of the threader hook 43 is formed in a rounded shape, it becomes possible for the threader hook 43 to suppress a damaging of the thread when capturing or releasing the thread.

(6) When the above-explained needle threader A is applied to a sewing machine, it becomes possible to provide a sewing machine which can surely perform a needle threading operation highly safely.

Moreover, according to the thread holding mechanism A3 of this embodiment, the following advantages can be accomplished.

(1) It is appropriate for the user to guide the thread only at the two positions that are the thread guide 13*a* and the thread gripper unit 30, enabling a smooth completion of a thread guiding operation.

(2) Conventional thread holding mechanisms have two thread guiding positions in addition to a thread guide, and thus it is necessary for the user to guide the thread at a total of three positions. In contrast, according to this embodiment, it is appropriate for the user to guide the thread at a total of two positions. Accordingly, a nearby space to the thread gripper unit 30 can be enlarged, which enables the user to safely carry out a thread guiding operation.

(3) With respect to the thread guided by the thread guide 13*a* and the thread gripper unit 30, the thread gripper unit 30 descends below the thread guide 13*a*, and the thread presser unit 33 abuts the thread. Hence, even if the thread is guided at only the two positions, the thread is surely pressed by the thread presser unit 33, and thus the thread can be held in a tensioned condition.

(4) When a part of the thread presser unit 33 abutting the thread is provided below the thread gripping position of the thread gripper unit 30, the tension of the thread can be further increased to ensure the holding.

(5) The presser bar 33*a* of the thread presser unit 33 has the inclined face formed at a part abutting the thread. Hence, it becomes possible to guide the thread once abutting the presser bar 33*a* to the basal end of the presser bar 33*a* while preventing the thread from being released from the presser bar 33*a*. Accordingly, it becomes possible to further surely hold the thread in a tensioned condition.

(6) The guide 30*b* provided in the thread gripper unit 30 is formed in such a way that the width becomes narrower toward the end of the notch. Hence, the thread guided by the user can be surely held, which makes the thread guiding operation further smooth. Moreover, since the guide 30*b* firmly holds the thread, the thread can be held in a further tensioned condition. Furthermore, the guide 30*b* has the width that becomes wider from the end of the notch to the origin part, making the release of the thread smooth.

(7) Since the leaf spring 34 is provided at the thread gripper unit 30, the thread guided by the thread gripper unit 30 can be surely held by the pushing force by the leaf spring 34. Moreover, the tension of the thread can be enhanced at the needle threading position.

(8) The application of the above-explained thread holding mechanism A3 to the needle threader A makes the thread guiding operation to the needle threader A smooth, and enables the needle threader A to maintain a sufficient tension of the thread for the needle threading operation. Hence, it becomes possible to provide the needle threader A that performs a needle threading operation further surely.

(9) When the above-explained thread holding mechanism A3 or the needle threader A both explained above is applied to a sewing machine, it becomes possible to provide the sewing machine which enables the user to carry out the thread guiding operation safely and smoothly, and which can hold the thread in a tensioned condition.

The present disclosure is not limited to the above-explained embodiment, and permits various modifications as needed. Although the explanation was given of the threader hook 43 of the needle threader A in the above-explained embodiment, the threader hook 43 is applicable to a component that captures the thread in a sewing machine. Moreover, the width of the part where the thread pathway becomes the narrowest is formed so as to be smaller than the outer diameter of the thread by forming the convexity, but the threader hook 43 may be formed in a hooky shape with a constriction to reduce the width of the thread pathway.

What is claimed is:

1. A needle threader of a sewing machine, the needle threader comprising:

a needle bar supporter to which a needle bar holding a needle with a needle hole is attached;

a threader shaft supported in a movable manner in a vertical direction and in a rotatable manner;

a thread holding mechanism which is held by the threader shaft and which applies a tension to a thread so as to be substantially horizontal ahead of the needle hole; and a threader mechanism which is held by the threader shaft and which comprises a hook that enters the needle hole upon a rotation of the threader shaft, wherein:

the hook comprises a capturing portion that captures the thread at a tip part of the capturing portion;

the capturing portion comprises a thread pathway where the thread enters or leaves, and a thread capturing space for capturing the thread; and a width of a part where the thread pathway becomes the narrowest is formed so as to be narrower than a width of the thread capturing space, wherein the thread enters the thread pathway in a tensioned condition, and the width of the part where the thread pathway becomes the narrowest is formed so as to be narrower than an outer diameter of the thread not in a tensioned condition.

2. The needle threader according to claim 1, wherein a convexity is provided in the thread pathway.

3. The needle threader according to claim 1, wherein:

the hook has a tip formed in a hooky shape;

the thread pathway is formed at a basal part of the hooky shape and a tip part thereof; and the convexity is provided at the basal part or the tip part.

4. The needle threader according to claim 2, wherein:

the hook is provided in a movable manner in the vertical direction; and the convexity has a tip part provided so as to be directed in a direction in which the hook moves.

5. The needle threader according to claim 2, wherein the convexity is formed in a rounded shape.

6. A sewing machine comprising the needle threader of claim 1.

* * * * *